US009490058B1

(12) United States Patent
Kluska et al.

(10) Patent No.: US 9,490,058 B1
(45) Date of Patent: Nov. 8, 2016

(54) MAGNETIC COMPONENT WITH CORE GROOVES FOR IMPROVED HEAT TRANSFER

(75) Inventors: Ted Kluska, Madison, AL (US); Donald Folker, Madison, AL (US); Deborah Pinkerton, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 444 days.

(21) Appl. No.: 13/007,420

(22) Filed: Jan. 14, 2011

(51) Int. Cl.

| | |
|---|---|
| ***H01F 27/08*** | (2006.01) |
| ***H01F 27/02*** | (2006.01) |
| ***H01F 27/29*** | (2006.01) |
| ***H01F 27/24*** | (2006.01) |
| ***H01F 27/22*** | (2006.01) |
| ***H01F 27/32*** | (2006.01) |

(52) U.S. Cl.
CPC ..... *H01F 27/22* (2013.01); *H01F 27/08* (2013.01); *H01F 27/322* (2013.01)

(58) Field of Classification Search
USPC ..... 336/55, 60, 61, 90, 192, 212
See application file for complete search history.

(56) References Cited

U.S. PATENT DOCUMENTS

| | | | | |
|---|---|---|---|---|
| 2,565,303 | A * | 8/1951 | Garbarino | 336/217 |
| 2,882,506 | A * | 4/1959 | Brooks et al. | 336/210 |
| 5,034,854 | A * | 7/1991 | Matsumura et al. | 361/744 |
| 5,094,769 | A | 3/1992 | Anderson, Jr. et al. | |
| 5,140,291 | A * | 8/1992 | Mulder et al. | 336/198 |
| 5,469,124 | A | 11/1995 | O'Donnell et al. | |
| 5,781,412 | A | 7/1998 | de Sorgo | |
| 5,929,734 | A | 7/1999 | Weiner | |
| 6,144,282 | A * | 11/2000 | Lee | 336/234 |
| 6,185,811 | B1 | 2/2001 | Perry | |
| 6,202,738 | B1 | 3/2001 | Tanaka et al. | |
| 6,259,347 | B1 * | 7/2001 | Sines | 336/219 |
| 6,472,969 | B1 * | 10/2002 | Hanato | 336/192 |
| 6,492,890 | B1 | 12/2002 | Woznlczka | |
| 6,525,637 | B1 | 2/2003 | Van Gestel et al. | |
| 6,662,431 | B1 * | 12/2003 | Lu et al. | 29/602.1 |
| 6,879,237 | B1 | 4/2005 | Viarouge et al. | |
| 7,130,197 | B2 | 10/2006 | Chin | |
| 7,477,519 | B2 | 1/2009 | Kubo | |
| 7,498,917 | B1 * | 3/2009 | Yang | 336/90 |
| 7,701,320 | B2 | 4/2010 | Iwakura et al. | |
| 8,242,870 | B1 * | 8/2012 | Folker | 336/198 |
| 8,427,267 | B1 * | 4/2013 | Vinciarelli | 336/178 |
| 2005/0231316 | A1 * | 10/2005 | Sato | 336/212 |
| 2009/0079528 | A1 * | 3/2009 | Shabany et al. | 336/61 |

FOREIGN PATENT DOCUMENTS

JP 05036547 A * 2/1993

* cited by examiner

*Primary Examiner* — Tsz Chan
(74) *Attorney, Agent, or Firm* — Patterson Intellectual Property Law, P.C.; Mark J. Patterson

(57) ABSTRACT

A magnetic component for an electronic circuit includes a core having one or more core surface grooves defined on a side wall, an end wall or both, along the outer core perimeter. Each core surface groove can improve heat flux away from the magnetic component. In some embodiments, a thermally conductive gap filler material is disposed adjacent one or more of the core surface grooves. An electronic device includes a magnetic component with one or more core surface grooves positioned on a circuit board inside an enclosure. The gap filler material spans a gap between the magnetic component and an enclosure wall interior surface, thereby providing a thermal bridge between the component and the enclosure facilitating heat flux away from the core to the enclosure wall.

14 Claims, 9 Drawing Sheets

MAGNETIC COMPONENT WITH CORE GROOVES FOR IMPROVED HEAT TRANSFER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to magnetic circuit components and more particularly to magnetic components for mounting on a circuit board housed within a full or partial enclosure. The present invention also relates to electronic devices and associated methods of manufacturing enclosed electronic devices.

Magnetic components including a magnetically permeable core and one or more conductive windings positioned near the core are known in the art. Such components are used in conventional inductors and transformers in a variety of electronic applications. Magnetic components of this type can generally be configured for surface mounting on a circuit board for use in an electrical circuit. Common applications for such devices include, inter alia, power supplies, power converters and power regulators. These devices can be used, for example, in electric lighting applications for controlling or regulating electrical power delivered to an electrical load such as a lamp, bulb or LED. Typically, in these applications, the circuit board and the electronic components disposed on the circuit board are housed within an enclosure.

Conventional magnetic components configured for mounting on a circuit board generally include a core structure having one or more core legs extending outward from a core body. Each core leg has a leg height, a leg length and a leg width. A conductive winding including one or more turns of a conductive wire can be positioned around a core leg. In some conventional applications, primary and secondary windings are positioned around a core leg to form a transformer. The conductive winding or windings can be positioned on a bobbin structure, or coil former, in some applications. The bobbin structure can include an axial opening, and a core leg can be inserted into the axial opening such that the bobbin structure and the conductive coil both surround the core leg.

Because magnetic circuit components in electronic devices generate heat during use, it is generally desirable to dissipate heat away from such components to ensure proper circuit operation and to reduce the risk of component failure or fire inside the enclosure. Additionally, in many applications, a magnetic component such as an inductor or transformer forms the largest circuit component mounted on a circuit board in an electronic device. Thus, any enclosure formed to surround the circuit board must have interior dimensions sufficient to accommodate the size of the tallest circuit component, i.e. the transformer or inductor. Additionally, the growing trend of miniaturization in the electronics industry seeks to reduce electronic device profile, resulting in narrow gaps between interior enclosure walls and the surfaces of magnetic components mounted on the circuit board housed within the enclosure. However, the goal of miniaturizing electronic devices by reducing the space between components and enclosure walls can make the additional goal of heat dissipation away from enclosed magnetic components more difficult to achieve.

Others have tried to address the problem of dissipating heat from conventional magnetic components by providing a gap filler material between the magnetic component and the enclosure wall. The gap filler material allows the enclosure wall to act as a thermal bridge or heat sink to dissipate heat away from the magnetic component. Heat generated in the magnetic component transfers from the core, bobbin or winding through the gap filler into the enclosure wall. From the enclosure wall, the heat can be further dissipated to the surrounding environment or can be passed to heat dissipation structures such as cooling fins. The heat can then be removed from the enclosure or cooling fins by natural or forced convection and/or radiation to the surrounding environment.

Heat flux from the magnetic core to the gap filler is partially a function of the surface area in contact between the gap filler and the magnetic component. One problem associated with conventional magnetic components is inadequate surface area contact between the gap-filler and the magnetic component for optimal heat flux from the magnetic component.

Another problem associated with conventional magnetic components is a tendency of the gap filler to become locally separated from the surface of the magnetic component over time. When surface separation between the gap filler and the magnetic component occurs, heat dissipation is greatly diminished.

What is needed, then, are improvements in the devices and associated methods for dissipating heat from magnetic components in electric circuits.

BRIEF SUMMARY OF THE INVENTION

The present invention provides a core for a magnetic component having one or more surfaces including a recessed area, slot, or groove defined therein. The recessed area is generally positioned on the core to engage a thermal gap filler material which forms a bridge between the magnetic component and a nearby enclosure wall.

One embodiment of the present invention provides a magnetic component apparatus for an electronic circuit including a core defining an outer core perimeter. A bobbin is disposed about the core, and a conductive winding is disposed about the bobbin. The core defines a plurality of surface grooves in the outer core perimeter.

A further embodiment of the present invention provides a magnetic component apparatus for an electronic circuit including a core having a core body. The core body defines an end core surface and an upper core surface. The upper core surface is oriented substantially perpendicular to the end core surface. The core body defines a core body height. A first side core leg extends substantially perpendicularly from the core body, and the first side core leg defines a first side core surface. A second side core leg extends substantially perpendicularly from the core body, and the second side core leg defines a second side core surface. A middle core leg protrudes substantially perpendicularly from the core body between the first and second side core legs. Also, the core includes a plurality of surface grooves defined on the end core surface. Each one of the plurality of surface grooves extends downward from the upper core surface in a direction substantially orthogonal to the upper core surface.

Yet another embodiment of the present invention provides a magnetic component apparatus for an electronic circuit including a core having a core body. The core body has an end core surface and an upper core surface. The upper core surface is oriented substantially perpendicular to the end core surface. The core body defines a core body height. A first side core leg extends substantially perpendicularly from the core body, and the first side core leg defines a first side core surface. A second side core leg extends substantially perpendicularly from the core body, and the second side core leg defines a second side core surface. The end core surface and first and second side core surfaces comprise an outer core perimeter. A middle core leg protrudes substantially perpendicularly from the core body between the first and second side core legs. The core defines a plurality of surface grooves on the side core surface, and each one of the plurality of surfaces grooves extends downward from the upper core surface in a direction substantially orthogonal to the upper core surface.

Another embodiment of the present invention provides an electronic device including an enclosure defining an enclosure wall having an interior enclosure wall surface. A magnetic component is positioned in the enclosure. The magnetic component includes a core comprising a magnetically permeable material. The core includes an upper core surface substantially facing the interior enclosure wall surface, and the core defines an outer core perimeter. A plurality of surface grooves are defined in the outer core perimeter, and each surface groove is oriented substantially perpendicular to the upper core surface. A gap filler material is disposed between the upper core surface and the interior enclosure wall surface, and the gap filler material extends away from the interior enclosure wall surface into at least one of the plurality of surface grooves.

One object of the present invention is to provide a passive cooling system for an electronic device including an enclosure having an enclosure wall and defining an enclosed volume. A magnetic component is disposed in the enclosed volume. The magnetic component includes a core having one or more core grooves defined on the outer core perimeter. The core grooves can be defined in the core body or on a core leg. A gap filler material is positioned in the enclosed volume between at least one core groove and the enclosure wall. The gap filler material forms a heat flux path for dissipating heat away from the core.

Numerous other objects, features and advantages of the present invention will be readily apparent to those skilled in the art upon a reading of the following disclosure when taken in conjunction with the accompanying drawings.

DETAILED DESCRIPTION OF THE INVENTION

Figure 1:
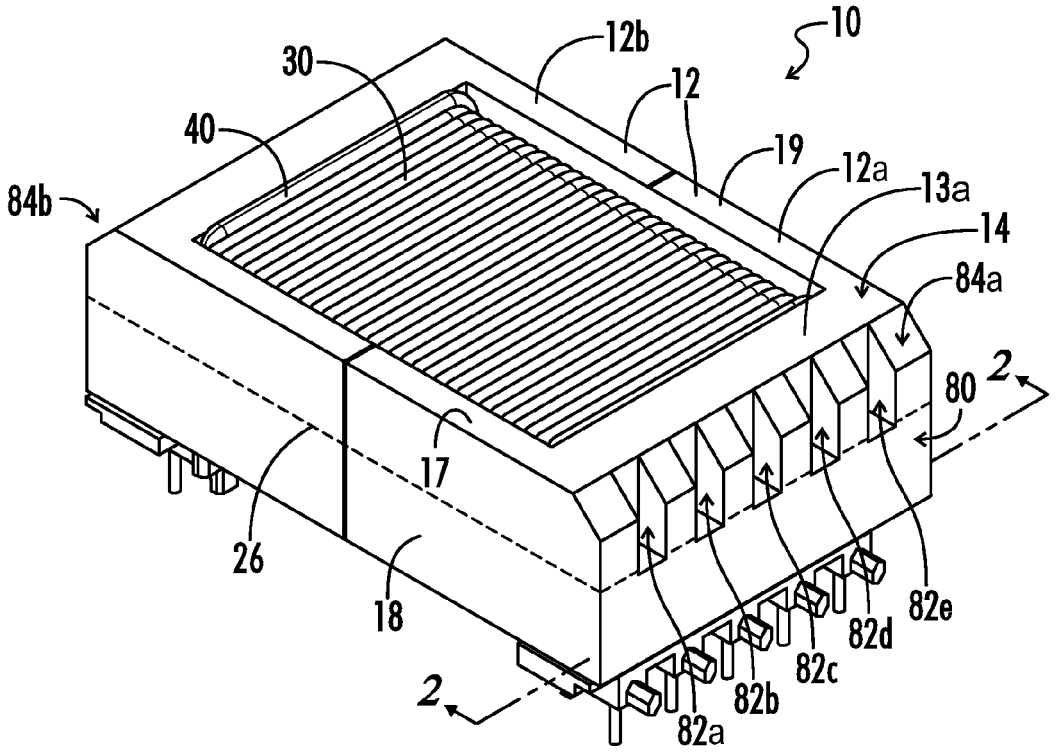
FIG. 1 illustrates a perspective view of an embodiment of a magnetic component having end core surface grooves in accordance with the present invention.

Referring now to the drawings, FIG. 1 illustrates a perspective view of an embodiment of a magnetic component 10 in accordance with the present invention. Magnetic component 10 can include a transformer or an inductor in some embodiments. Although magnetic component 10 is illustrated in a horizontal position in FIG. 1, it will be readily appreciated by those of skill in the art that magnetic component 10 and other devices referred to herein can assume numerous other orientations not shown. Accordingly, terms of direction such as up, down, vertical, horizontal, top, bottom, upper lower, etc. are used to refer to the apparatus as illustrated in the drawings to designate a spatial relationship between features of the device such as surfaces, corners, etc. and are not intended as limitations upon the scope of the invention.

Figure 9:
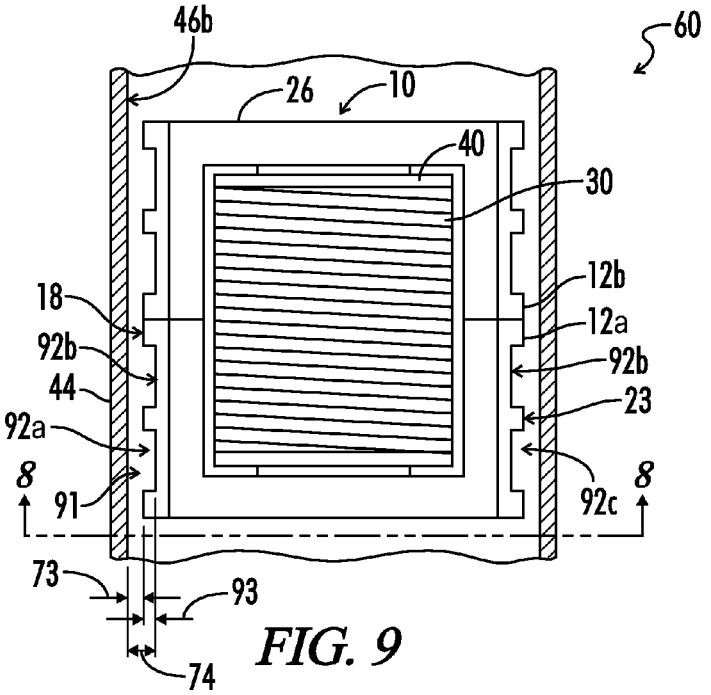
FIG. 9 illustrates a partial interior plan view of an electronic device having an enclosure and a magnetic component with a plurality of side core surface grooves housed within the enclosure.
Figure 10:
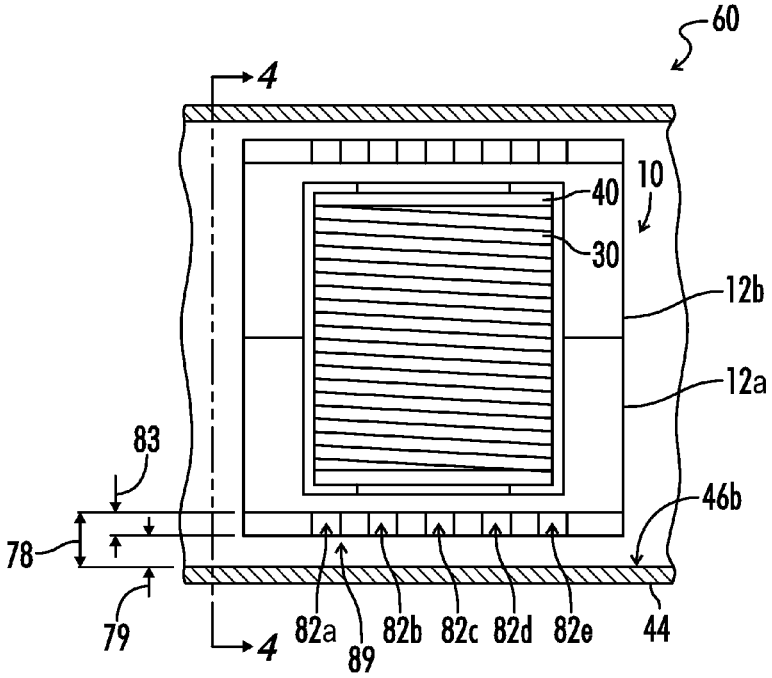
FIG. 10 illustrates a partial interior plan view of an electronic device having an enclosure and a magnetic component with a plurality of end core surface grooves housed within the enclosure.

Magnetic component 10 generally includes a core 12. The core 12 may be formed of a magnetically permeable material such as a ferrite or other suitable material. Core 12 can include a first core half 12*a* and a second core half 12*b*. Each core half 12*a*, 12*b* can be positioned facing each other, as illustrated in FIG. 1, FIG. 9 and FIG. 10, such that a continuous magnetic flux path is defined generally around the outer core perimeter 26.

Each core half 12*a*, 12*b* can be a standard or modified E-core. In some embodiments, both first core half 12*a* and second core half 12*b* are standard or modified E-cores. In other embodiments, only one core half is a standard or modified E-core, and the other core half is a single column or rod of magnetically permeable material.

In some embodiments, magnetic component 10 includes an inductor or a transformer. Magnetic component 10 can form a bobbin-wound component wherein a bobbin 40 is disposed about core 12. Bobbin 40 can include a conventional winding bobbin known in the art and generally includes an axial opening. Core 12 may have a protruding leg extending into the axial opening of bobbin 40. One or more conductive windings 30 can be wound around the bobbin 40. The conductive winding 30 can be a single-turn conductive winding or a multiple turn conductive winding. In some embodiments, a primary winding and a secondary winding are both wound about the bobbin, forming a transformer. Conductive winding 30 can include multiple winding layers. In additional embodiments, bobbin 40 may be an integral single-turn winding embedded in the bobbin material.

Referring again to FIG. 1, magnetic component 10 includes a plurality of core surface grooves defined in the outer core perimeter. Each core surface groove is defined in the outer core perimeter 26 to provide improved heat transfer away from the core to the surroundings. Core surface grooves increase the surface area for heat transfer to a nearby structure such as a heat sink, fin bank, heat exchanger or enclosure wall via an intermediate thermally conductive gap filler material such as a thermal grease or a thermal pad disposed between core 12 and the nearby structure. Additionally, core surface grooves provide enhanced mechanical engagement with a material disposed on the core and can prevent surface separation.

Figure 2:
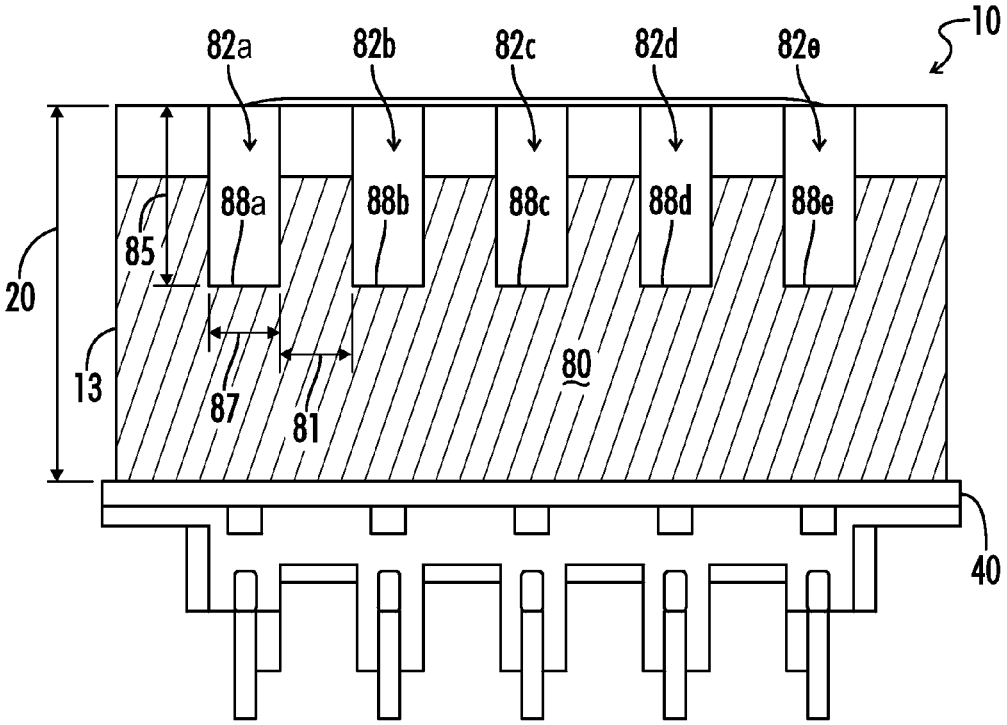
FIG. 2 illustrates an end elevation view of Section 2-2 of an embodiment of a magnetic component from FIG. 1.

As seen in FIGS. 1-3D, in some embodiments, core 12 includes a core body 13 generally defining an upper core surface 14. FIG. 3C illustrates a schematic top view of first core half 12*a*. As seen in FIG. 3C, first core half 12*a* includes core body 13 forming a lateral yoke having a plurality of core legs extending substantially perpendicularly outward therefrom. Core body 13 defines an end core surface 80. End core surface 80 generally forms one side of outer core perimeter 26. Upper core surface 14 is oriented substantially perpendicular to end core surface 80 in some embodiments. As seen in FIG. 2, core body 13 generally defines a core body height 20. The core body height 20 can range from about one millimeter to about ten centimeters in some embodiments. In additional embodiments, the core body height 20 can be greater than ten centimeters.

Figure 3A:
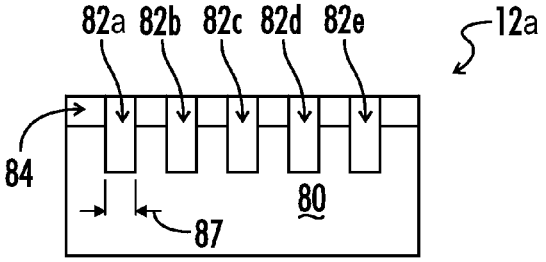
FIG. 3A illustrates an end elevation view of an embodiment of a core in accordance with the present invention.
Figure 3B:
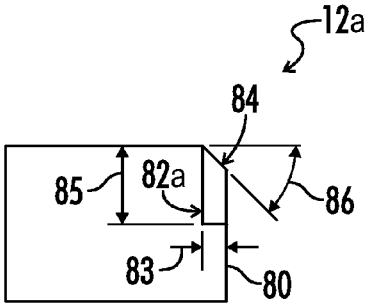
FIG. 3B illustrates a side elevation view of the embodiment of a core from FIG. 3A.
Figure 3C:
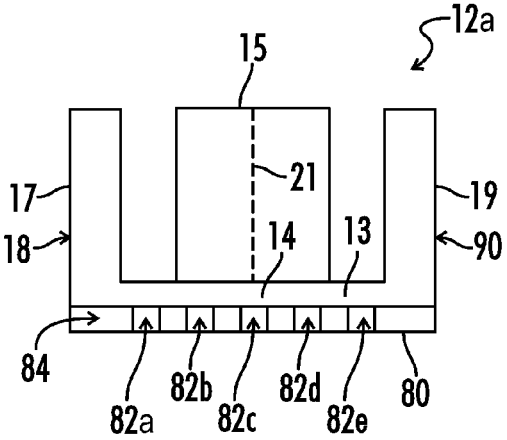
FIG. 3C illustrates a top view of the embodiment of a core from FIG. 3A.

Referring to FIG. 3C, in some embodiments, a first side core leg 17 extends from core body 13. First side core leg 17 is extends in a direction substantially perpendicular to core body 13 in some embodiments. First side core leg 17 defines a first side core surface 18. First side core surface 18 forms one side of outer core perimeter 26. Similarly, a second side core leg 19 extends from core body 13 in a direction substantially perpendicular to core body 13 in some embodiments. Second side core leg 19 defines a second side core surface 90. Second side core surface 90 also forms one side of outer core perimeter 26.

Also seen in FIG. 3C, a middle core leg 15 protrudes substantially perpendicularly from core body 13 between first side core leg 17 and second side core leg 19. Middle core leg 15 has a middle core leg axis 21 along which middle core leg 15 extends from core body 13. In some embodiments, end core surface 80 is substantially orthogonal to middle core leg axis 21.

Figure 3D:
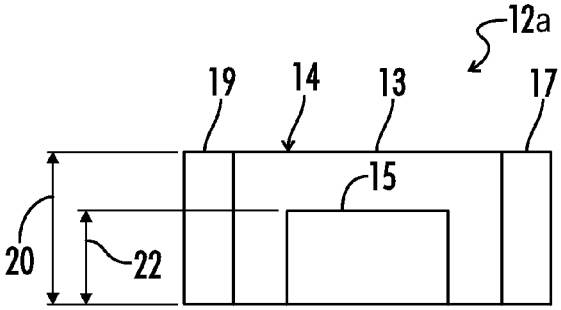
FIG. 3D illustrates a front end elevation view of the embodiment of a core from FIG. 3D.

As seen in FIG. 3D, in some embodiments, middle core leg 15 has a middle core leg height 22. In some embodiments, the middle core leg height 22 is less than the core body height 20. By providing a middle core leg height 22 less than core body height 20, bobbin 40 can be positioned on core 12, and particularly on middle core leg 15, such that bobbin 40 and winding 30 do not extend substantially above upper core surface 14. For example, as seen in FIG. 1 and FIG. 2, core 12 is positioned on bobbin 40, such that upper core surface 14 is substantially flush with the top of conductive winding 30 and bobbin 40. Such a configuration allows a reduction of the profile of magnetic component 12 and allows use of a smaller enclosure when magnetic component 12 is positioned within an electronic device. In some embodiments, the conductive winding 30 defines a winding height extending from the bottom elevation of the core body to the uppermost region of the conductive winding. In some embodiments, the ratio of the winding height to the core body height is less than about 1.1. In further embodiments, the ratio of the winding height to the core body height is about 1.0. In additional embodiments, the ratio of the winding height to the core body height is less than one.

In some embodiments, core 12 defines a plurality of end core surface grooves 82*a*, 82*b*, 82*c*, etc. on end core surface 80. Each one of the plurality of end surface grooves extend downward from upper core surface 14 in a direction substantially orthogonal to upper core surface 14. A seen in FIG. 1 and FIG. 2, each end surface groove 82*a*, 82*b*, etc. may have a rectangular profile extending in a direction substantially normal to upper core surface 14. Each end surface groove 82*a*, 82*b*, . . . defines an end surface groove height 85 (FIG. 2). End surface groove height 85 extends from the top of the end surface groove nearest upper core surface 14 to the bottom of the end surface groove nearest the bottom of core body 13. In some embodiments, one or more end surface grooves 82*a*, 82*b*, . . . do not extend completely along the entire core body height 20 and can be referred to as blind end surface grooves. As such, each blind end surface groove 82*a*, 82*b*, etc. as illustrated in FIG. 1, includes a corresponding end surface groove shelf 88*a*, 88*b*, etc. Each end surface groove shelf 88*a*, 88*b*, etc. can be oriented parallel to upper core surface 14 in some embodiments. In additional embodiments, each end surface groove shelf 88*a*, 88*b*, etc. can be oriented at an acute angle relative to upper core body surface 14 to facilitate flow of a thermally conductive material onto end core surface 80 from an end surface groove.

In additional embodiments not shown, each end surface groove 82*a*, 82*b*, etc. can have an end surface groove height 85 substantially equal to core body height 20. In these embodiments, each end surface groove 82*a*, 82*b*, etc. is a clearance groove and does not include an end surface groove shelf. Such embodiments can facilitate deeper vertical penetration of a thermally conductive material along end core surface 80 of core body 13 for improved heat transfer performance.

As seen in FIG. 2 and FIG. 3A, each end surface groove 82 has an end surface groove width 87. Additionally, as seen in FIG. 3B, each end surface groove 82 has an end surface groove depth 83. In some embodiments, the end surface groove depth 83 and end surface groove width 87 define the cross-sectional profile of the end surface groove 82 in a direction orthogonal to upper core surface 14. The end surface groove cross-sectional profile may be rectangular, as seen in FIG. 1. In other embodiments, not shown, the cross-sectional profile of end surface groove can have other suitable polygonal or curvilinear shapes not shown, including triangular, trapezoidal, pentagonal, hexagonal, etc.

Also seen in FIG. 2, adjacent end surface grooves 82 are separated by an end surface groove spacing distance 81. Each end surface groove spacing distance 81 can be uniform across end core surface 80. The end surface groove spacing distance 81 in some embodiments is equal to or less than end surface groove width 87. By providing a uniform end surface groove spacing distance 81 in some embodiments, a uniform magnetic flux path can be provided in core 12 such that end surface grooves do not interfere with the magnetic performance of core 12. Additionally, in some embodiments, each end surface groove height 85 is equal to the difference between core body height 20 and middle core leg height 22 to facilitate a desirable magnetic flux through magnetic core 12.

In some embodiments, the core 12 defines a beveled edge intersecting at least one of the plurality of surface grooves. The beveled edge is generally positioned adjacent upper core surface 14.

As seen in FIG. 1, an end beveled edge 84*a* is defined on first core half 12*a* between upper core surface 14 and end core surface 80. End beveled edge 84*a* is generally oriented transverse to each one of the plurality of end surface grooves 82*a*, 82*b*, etc. End beveled edge 84, as seen in FIG. 3B, includes an end beveled edge angle 86 relative to upper core surface 14. The end beveled edge angle 86 can range between about ten degrees and about eighty degrees in some embodiments. In an additional embodiment, the end beveled edge angle 86 is between about thirty degrees and about sixty degrees. In a particular embodiment, the end beveled edge angle 86 is about forty-five degrees. The end beveled edge 84 generally facilitates flow of a thermally conductive gap filler material onto end core surface 80 from upper core surface 14. Additionally, a second end beveled edge 84*b* can be defined on second core half 12*b*, as seen in FIG. 1. In this embodiment, first core half 12*a* and second core half 12*b* are generally similar and interchangeable parts, thus simplifying construction of magnetic component 12 and reducing manufacturing costs.

Figure 4:
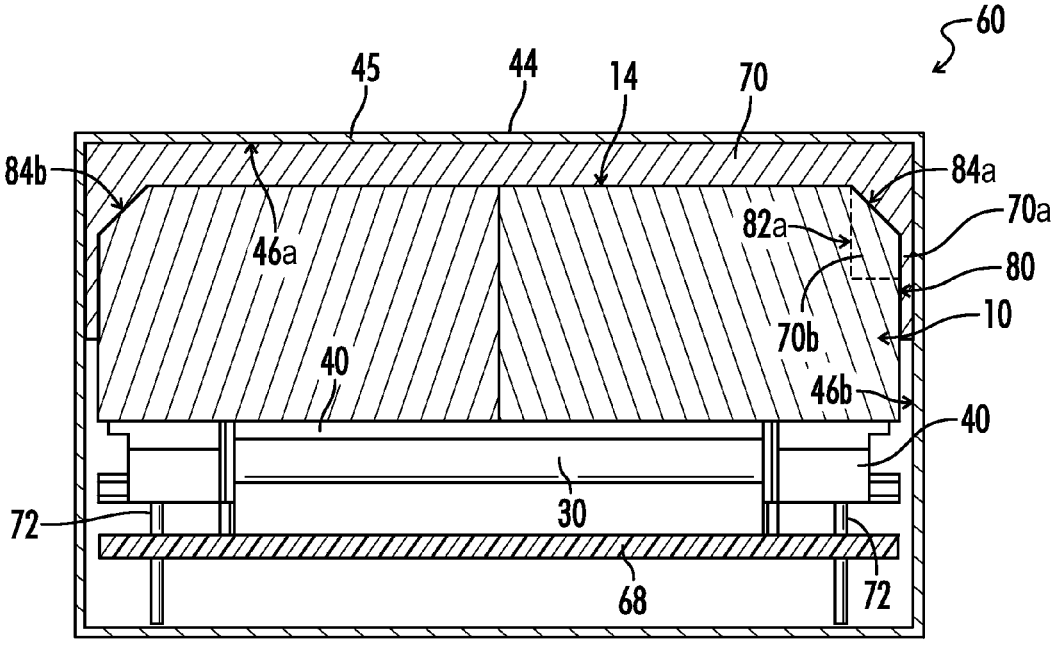
FIG. 4 illustrates an interior side view of an embodiment of an electronic device including an enclosure, a magnetic component housed within the enclosure and a gap filler material disposed between the magnetic component and the enclosure in accordance with the present invention.

Referring now to FIG. 4, a magnetic component apparatus 12 is housed inside an enclosure 44, forming an electronic device 60. Enclosure 44 can include a structure having a plurality of panels for covering some or all of magnetic component 12. A circuit board 68 is housed in enclosure 44, and magnetic component 12 can be mounted on circuit board 68, along with other circuit components. The electronic device 60 can be or include a power supply, power regulator, power converter, an electronic ballast for lighting applications, or another type of electronic device. Circuit board 68 can be a printed circuit board or other type of circuit substrate. The magnetic component 12 can include one or more winding leads 72 extending from bobbin 40 toward circuit board 68. Each winding lead 72 may be connected to a conductive winding 30 disposed about bobbin 40 and further connected to an electric circuit disposed on circuit board 68 for operatively and mechanically connecting magnetic component 12 to a circuit.

Enclosure 44 includes an enclosure wall 45 surrounding magnetic component 12. The enclosure wall 45 defines an interior enclosure wall surface 46. The interior enclosure wall surface 46 generally faces core 12. In the embodiment illustrated in FIG. 4, the interior enclosure wall surface 46 includes a plurality of enclosure wall surfaces 46*a*, 46*b*, 46*c*, etc. Interior enclosure top wall surface 46*a* generally faces upper core surface 14. Interior enclosure end wall surface 46*b* generally faces end core surface 80. Interior enclosure side wall surface 46*c* generally faces side core surface 18.

A gap filler material 70 is disposed in enclosure 44 between enclosure 44 and magnetic component 12. More particularly, in some embodiments, gap filler material 70 is positioned between upper core surface 14 and interior enclosure wall to surface 46*a*. Gap filler material 70 provides a thermal bridge between core 12 and enclosure wall 45 and facilitates heat flux from magnetic component 10 to enclosure 44 for cooling magnetic component 10 during use. In some embodiments, gap filler material 70 may be a thermally conductive material such as a thermal grease, thermal gel, thermal paste, heat sink gel, heat sink paste, thermal pad, etc. Gap filler material 70 in some embodiments may be a material having a thermal conductivity greater than about 1.0 W/(m-K). Gap filler material 70 in some embodiments can include a metal such as aluminum or silver, a metal oxide such as beryllium oxide, aluminum nitride, aluminum oxide, zinc oxide, silicon dioxide, or a carbon-based material such as graphite or graphene, or mixtures thereof. Additionally, gap filler material 70 can be in the form of a paste, gel, liquid, or compressible solid in some embodiments.

During electronic device assembly, gap filler material 70 can be positioned on magnetic component 10 before enclosure wall 45 is positioned near core 12. As enclosure wall 45 is moved into a fully-seated, or closed, position, excess gap filler material 70 can be compressed against magnetic component 10, thereby establishing surface contact between and interior enclosure wall surface 46 and gap filler material 70, and also establishing surface contact between gap filler material 70 and upper core surface 14. Alternatively, the gap filler material 70 can be positioned on enclosure wall 45 before enclosure wall 45 is positioned in a closed position near magnetic component 10. As such, gap filler material 70 can be pressed against magnetic component 10 and can conform to the shape of magnetic component 10, thereby filling any macroscopic or microscopic voids on the surface of magnetic component 10, including heat transfer grooves defined in end core surface 80.

Referring to FIG. 10, in some embodiments, an end gap 89 is defined between the interior enclosure end wall surface 46*b* and end core surface 80. The end gap 89 defines an end gap distance 79 as the distance between end core surface 80 and interior enclosure end wall surface 46*b*. The end gap distance 79 in some embodiments is less than end surface groove depth 83. Providing an end gap distance 79 less than end surface groove depth 83 in some applications would not function properly due to inadequate heat transfer using conventional core designs. However, such embodiments are achievable in some applications in accordance with the present invention because end surface grooves 82*a*, 82*b*, etc. allow enhanced heat transfer from core 12 to enclosure 44. As seen in FIG. 4, in some embodiments, a first portion of gap filler material 70*a* extends into end gap 89 between the interior enclosure end wall surface 46*b* and end core surface 80. A first portion of gap filler material 70*a* provides a thermal path for heat flux away from magnetic component 10 into enclosure 44. Additionally, a second portion of gap filler material 70*b* also extends into at least one of the plurality of end surface grooves 82*a*, 82*b*, etc. An end recess gap distance 78 is defined as the distance between interior enclosure end wall surface 46*b* and the innermost region of and end surface groove 82. Each end surface groove 82*a*, 82*b*, etc. may be filled with gap filler material 70. As such, gap filler material 70 disposed between magnetic component 10 and interior enclosure end wall surface 46*b* includes a variable lateral thickness ranging from end recess gap distance 78 to end gap distance 79.

Also seen in FIG. 4, in some embodiments, end beveled edge 84*a* is angled so that gap filler material 70 can flow, or be pushed downward, more easily into end gap 89. Similarly, second end beveled edge 84*b* defined on second core half 12*b* facilitates flow of gap filler material between second core half 12*b* and enclosure 44.

Figure 5:
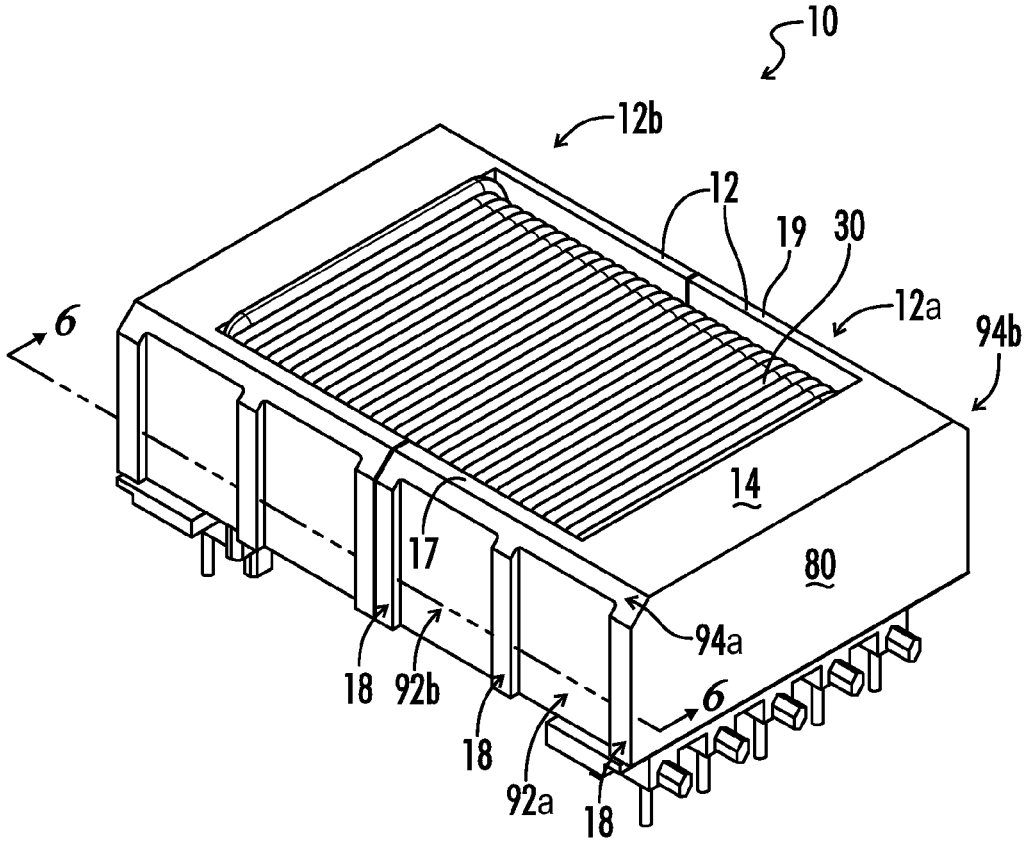
FIG. 5 illustrates a perspective view of an embodiment of a magnetic component having side core surface grooves in accordance with the present invention.

Referring now to FIG. 5, in further embodiments of the present invention, a magnetic component 10 includes one or more surface grooves 92*a*, 92*b*, etc. defined on a side core surface. For example, side core surface grooves 92 can be defined on a first side core surface 18 on first side core leg 17 or on second side core surface 23 on a second side core leg 19. Each side core surface groove 92*a*, 92*b*, etc. is generally defined extending downward from upper core surface 14 in a direction substantially orthogonal to upper core surface 14.

Figure 6:
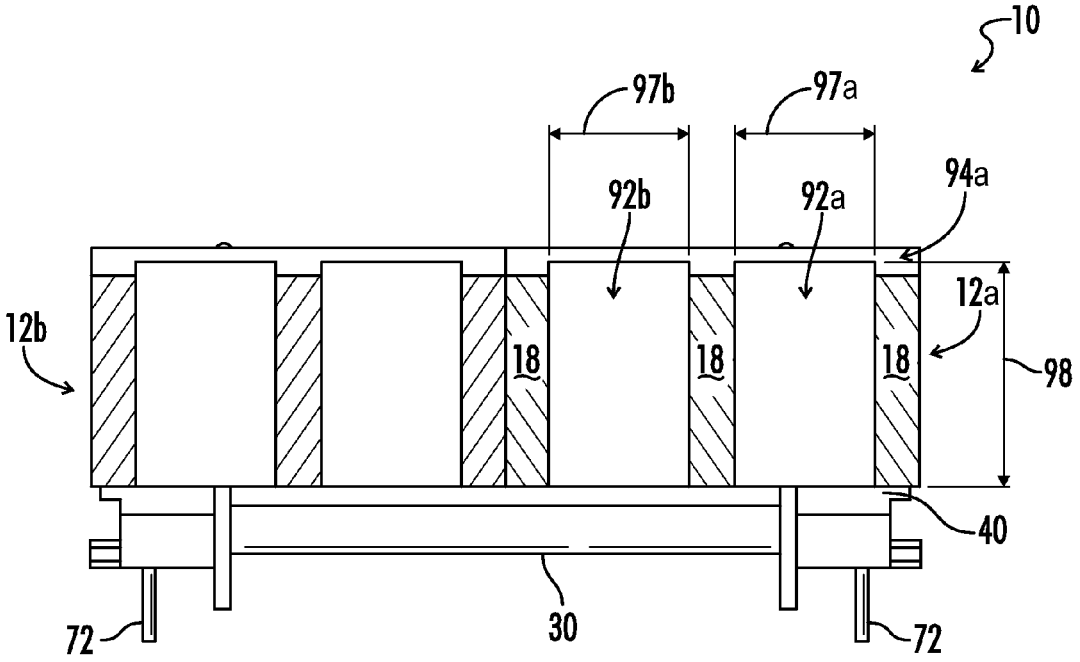
FIG. 6 illustrates a side elevation view of the embodiment of a magnetic component from FIG. 5.

As seen in FIG. 6, each side core surface groove 92*a*, 92*b*, defines a side core surface groove width 97*a*, 97*b*, respectively. In some embodiments, each side core surface groove width is equal. In other embodiments, each side core surface groove 92*a*, 92*b* can include different side core surface groove widths.

Also seen in FIG. 6, in some embodiments, each side core surface groove includes a side core surface groove height 98. In some embodiments, each side core surface groove 92*a*, 92*b*, etc. can be referred to as a clearance side core surface groove. The side core surface groove height 98 is equal to core body height 20. In such embodiments, each side core surface groove extends from upper core surface 14 to the bottom of core body 13. In other embodiments, each side core surface groove 92*a*, 92*b*, etc. can be referred to as a blind side core surface groove wherein each side core surface groove extends from upper core surface 14 to a height less than core body height 20. As such, each side core surface groove extends only partially down the side core surface, and side core surface groove depth 78 is less than core body height 20. In such blind side core surface groove embodiments, not shown, a side core groove shelf defines the bottom of the side core groove partially down the side core surface.

Referring further to FIG. 6 and FIGS. 7A-7D, a side beveled edge 94*a* can be defined in core 12 between upper core surface 14 and first side core surface 18. Similarly, a second side beveled edge 94*b* can be defined in core 12 between upper core surface 14 and second side core surface 23. Each side beveled edge may have a side corner bevel angle 96. The side corner bevel angle 96 can range between about ten degrees and about eighty degrees. In some embodiments, the side corner bevel angle 96 can range between about thirty degrees and about sixty degrees. In some particular embodiments, the side corner bevel angle 96 is about forty-five degrees. Each beveled edge 94*a*, 94*b* facilitates flow of gap filler material onto a side core surface or into a side core surface groove.

Figure 7A:
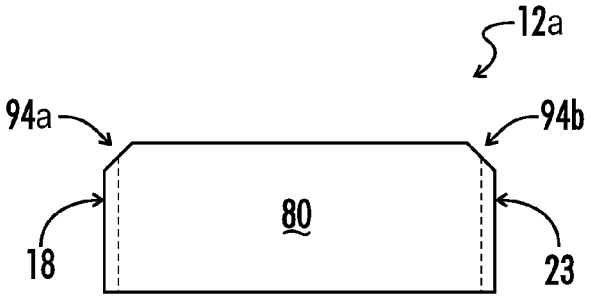
FIG. 7A illustrates an end elevation view of an embodiment of a core in accordance with the present invention.
Figure 7B:
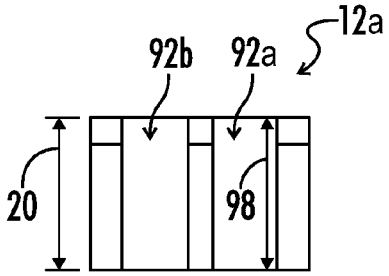
FIG. 7B illustrates a side elevation view of the embodiment of a core from FIG. 7A.
Figure 7C:
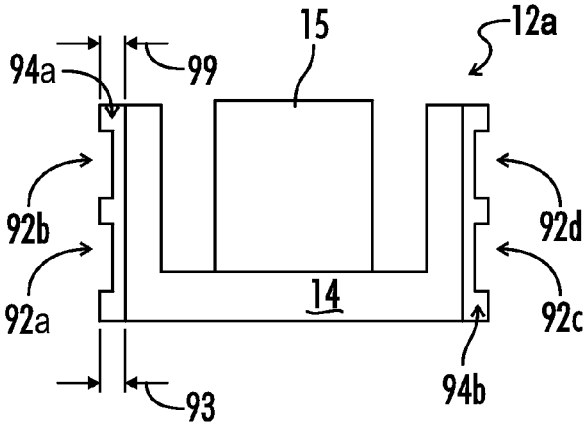
FIG. 7C illustrates a top view of the embodiment of a core from FIG. 7A.
Figure 7D:
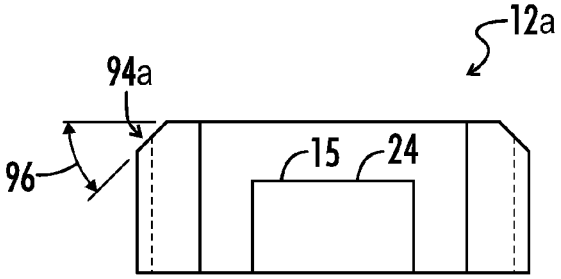
FIG. 7D illustrates a front elevation view of the embodiment of a core from FIG. 7A.

Referring further to FIG. 7C, each side core surface groove 92*a*, 92*b*, etc. has a side core surface groove depth 93. In some embodiments, each side core surface groove depth 93 extends a distance less than side core surface groove width. Each side core surface groove can have a rectangular profile in the direction normal to upper core body surface 14 in some embodiments. In other embodiments not shown, each side core surface groove may have other suitable polygonal or curvilinear shapes. In some embodiments, as seen in FIGS. 5, 6 and 7C, each side beveled edge 94 has a lateral side corner bevel depth 99 defined as the lateral distance side beveled edge 94 extends into the corresponding side core leg. In some embodiments, the side core surface groove depth 93 is less than the lateral side corner bevel depth 99.

Figure 8:
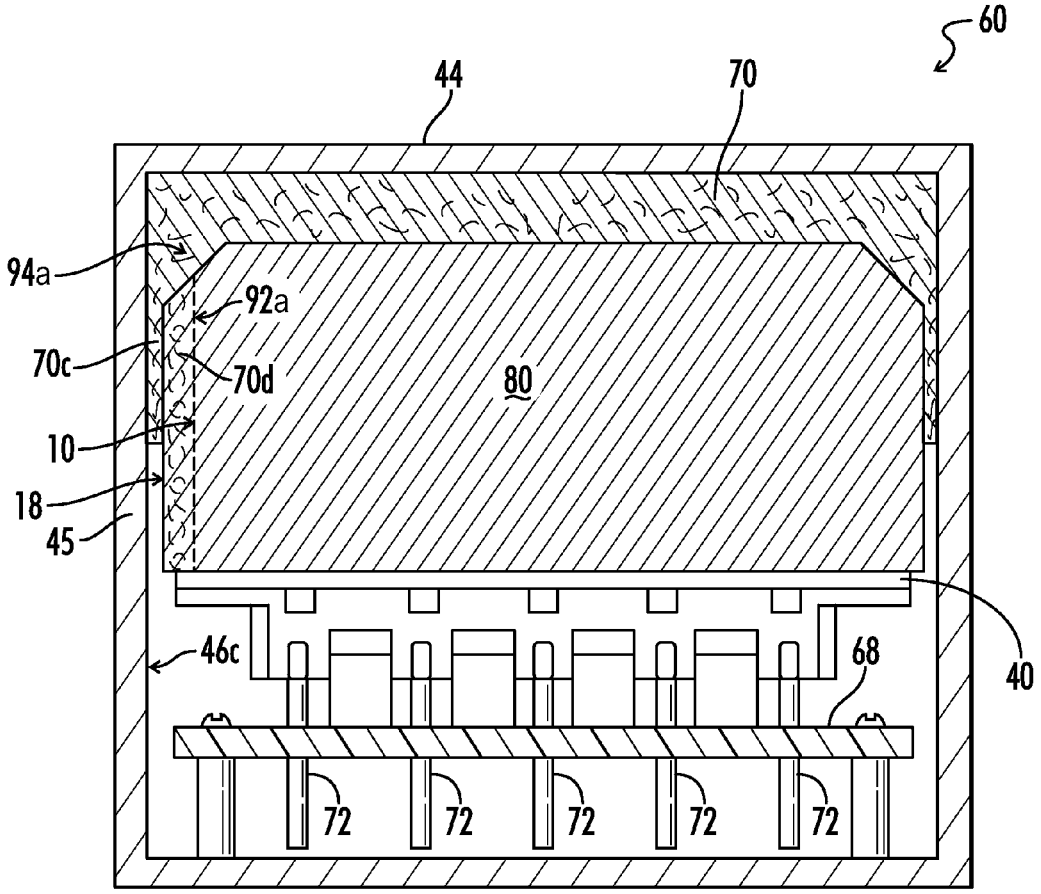
FIG. 8 illustrates an embodiment of an electronic device including an enclosure, a magnetic component housed within the enclosure and a gap filler material disposed between the magnetic component and the enclosure in accordance with the present invention.

Referring now to FIG. 8 and FIG. 9, in some embodiments an electronic device 60 may include a magnetic component 10 housed in an enclosure 44. The magnetic component 10 in this embodiment includes a core having one or more side core surface grooves 92*a*, 92*b*, etc. such as those illustrated in one embodiment in FIG. 6. A side gap 91, seen in FIG. 9, is defined between first side core surface 18 and interior enclosure wall side surface 46*c*. In some embodiments, a third region of gap filler material 70*c* is disposed in side gap 91. Similarly, a fourth region of gap filler material 70*d* can extend into one or more side core surface grooves 92*a*, 92*b*, etc. Gap filler material can fill the entire height of each side core surface groove in some embodiments. In other embodiments, gap filler material may fill only a partial region of each side core surface groove.

As seen in FIG. 9, the side gap 91 has a side gap distance 73 defined as the distance between interior enclosure side wall surface 46*c* and first side core surface 18. Similarly, a second side gap can be defined on the opposite side of magnetic component 10 between second side core surface 23 and the enclosure wall. In some embodiments, the side gap distance 73 is less than side core surface groove depth 93. In other embodiments, the side gap distance 73 is substantially equal to side core surface groove depth 93. In further embodiments, the side gap distance 73 is greater than side core surface groove depth 93. The electronic device 60 in some embodiments may have a side recess gap distance 74 defined as the distance from the innermost position of a side core surface groove 92 to the interior enclosure side wall surface 46*c*. The side recess gap distance 74 generally defines the maximum thickness of gap filler material between each side core surface groove and the interior enclosure side surface. In some embodiments, a variable gap filler thickness extends between core 12 and interior enclosure side wall surface 46*c*.

In additional embodiments, magnetic component 10 can include one or more end core surface grooves and one or more core side core surface grooves in accordance with the present invention. In such embodiments, the gap filler material can extend between each core surface groove and the nearest enclosure wall surface for dissipating heat away from the magnetic component to the enclosure.

Thus, although there have been described particular embodiments of the present invention of a new and useful MAGNETIC COMPONENT WITH CORE GROOVES FOR IMPROVED HEAT TRANSFER it is not intended that such references be construed as limitations upon the scope of this invention except as set forth in the following claims.

What is claimed is:

1. A magnetic component apparatus for an electronic circuit, comprising:

a core having an outer core perimeter, an upper core surface, and an end core surface;

an end beveled edge between the upper core surface and the end core surface;

a bobbin disposed about the core;

a conductive winding disposed about the bobbin; and the core further comprising a plurality of surface grooves in the outer core perimeter;

an enclosure having an enclosure wall surrounding the core, with a gap defined between the core and the enclosure wall;

a gap filler disposed between the enclosure wall and the core; and wherein the gap filler extends partially into at least one of the plurality of surface grooves.

2. The apparatus of claim 1, wherein the gap filler comprises a thermal grease having a thermal conductivity greater than about 1.0 W/(m-K).

3. The apparatus of claim 1, further comprising:

the end beveled edge intersecting at least one of the plurality of surface grooves; and each one of the plurality of surface grooves defining a surface groove direction substantially perpendicular to the upper core surface.

4. A magnetic component apparatus for an electronic circuit, comprising:

a core having a core body, the core body having an end core surface and an upper core surface, the upper core surface being oriented substantially perpendicular to the end core surface, the core body defining a core body a first side core leg extending substantially perpendicularly from the core body, the first side core leg having a first side core surface;

a second side core leg extending substantially perpendicularly from the core body, the second side core leg having a second side core surface;

a middle core leg protruding substantially perpendicularly from the core body between the first and second side core legs; and the core comprising a plurality of surface grooves on the end core surface, each one of the plurality of surface grooves extending downward from the upper core surface in a direction substantially orthogonal to the upper core surface and having a surface groove height and a surface groove depth, at least one of the surface groove heights being less than the core body, wherein none of the surface groove depths extends through the core body.

5. The apparatus of claim 4, wherein:

the middle core leg has a middle core leg height; and the middle core leg height is less than the core body height.

6. The apparatus of claim 4, wherein:

each one of the plurality of surface grooves has a rectangular profile in a direction normal to the upper core surface.

7. The apparatus of claim 4, wherein:

the core further comprises an end beveled edge between the upper core surface and the end core surface.

8. The apparatus of claim 4, wherein:

each one of the plurality of surface grooves has a surface groove height less than the core body height.

9. The apparatus of claim 4, wherein:

the total number of surface grooves in the end wall surface equals five.

10. An electronic device, comprising:

an enclosure comprising an enclosure wall having an interior enclosure wall surface;

a magnetic component positioned in the enclosure, the magnetic component including a core comprising a magnetically permeable material;

the core including an upper core surface substantially facing the interior enclosure wall surface, the core defining an outer core perimeter;

a plurality of surface grooves defined in the outer core perimeter, each surface groove oriented substantially perpendicular to the upper core surface;

the core including at least one beveled edge between the upper core surface and the outer core perimeter; and a gap filler material disposed between the upper core surface and the interior enclosure wall surface, the gap filler material extending away from the interior enclosure wall surface into at least one of the plurality of surface grooves.

11. The device of claim 10, wherein the core further comprises:

a core body having a core body height;

a middle core leg protruding from the core body, the middle core leg including a middle core leg height; and the middle core leg height being less than the core body height.

12. The device of claim 11, further comprising:

a conductive winding disposed about the middle core leg, the conductive winding having a winding height; and the ratio of the winding height to the core body height being less than about 1.1.

13. The device of claim 12, further comprising:

the gap filler material extending between the conductive winding and the enclosure.

14. The device of claim 11, wherein:

the middle core leg defining a middle core leg axis; and the core including an end surface oriented substantially perpendicular to the middle core leg axis, wherein the plurality of surface grooves are defined on the end core surface.

* * * * *